US006631599B1

(12) United States Patent
Takagi

(10) Patent No.: US 6,631,599 B1
(45) Date of Patent: Oct. 14, 2003

(54) PRECAST PANEL INSERT AND ATTACHMENTS THERETO

(75) Inventor: Kyozaburo Takagi, Centerville, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 0 days.

(21) Appl. No.: 10/113,028

(22) Filed: Apr. 1, 2002

(51) Int. Cl.[7] ..... E04C 3/00
(52) U.S. Cl. ..... 52/579; 52/414; 52/742
(58) Field of Search ..... 52/579, 742.13, 52/742.14, 414, 582.1, 586.2, 591.1, 592.1, 601, 596; 249/16

(56) References Cited

U.S. PATENT DOCUMENTS 4,333,280 A * 6/1982 Morton ..... 52/167.1
4,442,648 A 4/1984 Reece
4,659,057 A 4/1987 Felter
4,825,612 A 5/1989 Tupman
4,856,244 A 8/1989 Clapp
5,265,389 A 11/1993 Mazzone et al.
5,910,087 A 6/1999 Carter
5,956,912 A 9/1999 Carter et al.
6,067,757 A 5/2000 Olson et al.
6,219,982 B1 4/2001 Eyring
6,358,575 B1 * 3/2002 Spragg ..... 428/34.1
6,484,464 B1 * 11/2002 Ochoa ..... 52/414

FOREIGN PATENT DOCUMENTS

GB 2172622 A * 9/1986

* cited by examiner

*Primary Examiner*—Ramon O. Ramirez
(74) *Attorney, Agent, or Firm*—Killworth, Gottman, Hagan & Schaeff LLP

(57) ABSTRACT

A panel insert for attaching objects to a precast panel surface. The insert is made from a one-piece elongate body of plastic and comprises one or more attachment securing chambers that form a secure engagement with an attachment, where the attachment preferably includes architectural or related decorative features. At least one inward-facing spine can be included on the insert to help secure the insert to the panel. Preferably, the secure engagement between the decorative attachment and the attachment securing chamber is in the nature of an interlocking, male-female connection, where such connection may include either numerous shaped members on complementary surfaces to form a frictional fit, including a permanent snap-fit, or complementary trapezoidal shapes so that a protrusion, or detent, on the decorative attachment may be slid or pressed into the chamber for either a removable or permanent locking arrangement.

51 Claims, 9 Drawing Sheets

PRECAST PANEL INSERT AND ATTACHMENTS THERETO

BACKGROUND OF THE INVENTION

The present invention relates generally to cast-in features in concrete and related precast panels, and more particularly to an insert integrally-cast into a precast panel to allow decorative attachments to be affixed thereto, thereby improving the architectural attributes of the panel.

Precast construction of concrete wall panels for tilt-up and other types of construction is well-known in the art. In the tilt-up approach, forms, also known as form liners, are placed on a flat casting surface in the shape and dimension of the desired panel and filled with concrete. When the concrete cures, the forms may be removed, and the panel tilted up into a preferred, typically vertical, orientation, where it can be joined to structural frames or other panels. Additional structural reinforcements, such as rebar, can be placed within the form prior to pouring the concrete.

The present inventor has recognized a need for an insert that is inexpensive to manufacture and integrate into precast panels. An additional need exists for such an insert that can easily accept myriad attachments with minimal installation effort, yet secure enough to prevent the attachment from becoming decoupled once locked into place.

SUMMARY OF THE INVENTION

The need is met by the present invention, which comprises a panel insert used to provide connections in precast wall panels (generally) and tilt-up wall panels (specifically) such that attachments can be easily connected to the panel either prior to or once the panel is put in place. As used herein, a precast panel includes any panel that is formed from a cast material that upon curing hardens up, thereby allowing the panel to be subsequently placed in a desired location within a building structure. A tilt-up panel is a particular type of precast panel that is formed on a horizontal surface and tilted up into place upon curing of the cast material. The panel insert can take on many forms, including a long, continuous construction that can extend longitudinally substantially the entire length of a panel surface, or discrete, segmented pockets that can be easily integrated into a predetermined position within the panel. The degree of connection permanence between the insert and the attachment can be determined by the construction of the panel insert, specifically the attachment securing chamber portion of the insert. For example, a tapered attachment securing chamber geometry could permit a secure locking fit between the insert and the attachment, but still allow a slidable, non-permanent connection therebetween. Alternatively, a more permanent locking snap-fit could be effected by utilizing complementary engaging structures on the contacts between the attachment and the insert, and pressing the two of them together. The attachments, which are preferably used to present architectural and related decorative indicia, could also be utilitarian, as discussed below.

According to a first embodiment of the present invention, an insert configured to be integrally formed into a precast panel is disclosed. The insert defines a portion of the panel outer face, and serves as a place on the panel outer surface to which decorative and other attachments may be connected. The insert comprises a unitary structure made up of a pair of generally planar and laterally-spaced flanges defining an opening therebetween and an attachment securing chamber in connection with the flanges. In the present context, a structure is considered "unitary" when it is of one-piece construction. By way of example, a one-piece molded or extruded plastic component would be considered to exhibit unitary construction. In the present embodiment, the opening is disposed in the surface that is at least partially defined by the flanges such that the opening and the attachment securing chamber together define a channel in the outer face of the panel insert. This channel may possess a short, discrete longitudinal dimension, or may form the entire length of the insert. Attachments may subsequently be connected into one or more channels of the attachment securing chambers in the panel insert.

Optionally, the channel further comprises at least one attachment retention member. Additionally, the attachment securing chamber may comprise a pair of laterally-spaced sidewalls joined by a common base. In addition, the attachment retention member can be configured to form either a slidably engageable or frictional connection with the attachment. Thus, the insertion of an attachment into the channel of the attachment securing chamber could be effected by not only a frictional pressing into place of the former to the latter, such as by a snap-fit, but also by a longitudinally slidable engagement. Moreover, the attachment retention member, which is used to ensure that the attachment and channel will maintain their connectivity once they engage, can take on many forms. For example, it can be made up of numerous prismatic retention members disposed on at least one surface of the attachment securing chamber such that the plurality of prismatic retention members are configured to engage a complementary surface of the attachment. Prismatic retention members could be triangular, saw-tooth or trapezoidal in shape, for example. Preferably, but not necessarily, the relationship between the prismatic retention members and a complementary pattern in the decorative attachment is such that a permanent lock can be formed. In the present context, a locking arrangement is considered "permanent" where the connection between two members is such that they cannot be separated without severely curtailing or disabling their subsequent connective properties. In this configuration, a male-female connection could be effected by a snap-fit insertion of the prismatic retention members into the attachment securing chamber, where the prismatic retention members would resist separation from the complementary engaging surface of the attachment securing chamber once joined.

The attachment retention member can also be individual detents, or protrusions, emanating from one or more surfaces of the attachment securing chamber, or can be defined by a narrowness in the opening relative to the dimensions of the channel underneath. The latter can be achieved, for example, by a trapezoidal construction within the attachment securing chamber where the channel walls diverge in a direction going into the channel from the opening. This has the effect of having the sidewall of the inner surface of the attachment securing chamber being the retention member. Complementary shapes on an engaging member of the attachment (such as a detent) can then be slidably placed such that a secure connection is formed. The plurality of generally planar flanges can be configured such that they are substantially coplanar with each other, or where they are canted relative to each other. The insert may also include at least one inwardly-projecting spine extending from the attachment securing chamber or the generally planar flanges, in the latter case either by being laterally connected to the outer edge of the flange or somewhere off the inward-facing surface of the flange. This spine can be used to further engage the insert and the precast panel, and may further include a plurality of apertures therein to promote such engagement. Multiple such spines may be used to effect even more secure engagement.

According to another embodiment of the present invention, a panel insert is disclosed. The panel insert includes at least one each of an attachment securing chamber and a panel securing chamber, both defined by a pair of laterally-spaced sidewalls joined by a common base. The panel additionally includes a plurality of generally planar flanges laterally disposed relative to the chambers. The. panel securing chambers are coupled to the interior of the precast layer, as the panel material (such as concrete) can flow into the interstitial cavities defined by the panel securing chambers. Upon material hardening, a secure anchor is formed between them.

Optionally, the chambers are alternately juxtaposed relative one another such that the laterally-spaced sidewalls that are disposed therebetween are common to both. Preferably, the unitary structure is made of plastic, which is more preferably extruded, although other forms, such as injection molded plastic, may also be used. In such an extruded configuration, the generally planar flanges and the chambers are configured to extend along parallel longitudinal dimensions. To facilitate better attachment between the insert and the panel, at least one inwardly-projecting integral spine can be included on the insert such that it extends from one of the chambers or at least one of the plurality of generally planar flanges. The spine may also include a plurality of apertures disposed therein to facilitate improved connectivity with the precast panel since the precast material, upon curing, solidifies in and around the spine. Moreover, the plurality of generally planar flanges can be substantially coplanar with one another and the opening of the one or more attachment securing chambers. The attachment securing chambers include at least one attachment retention member disposed on at least one of the laterally-spaced sidewalls. The attachment retention member may be made up of numerous prismatic retention members disposed on at least one surface of the sidewalls such that the prismatic retention members are configured to engage a complementary surface of the decorative attachment. As an alternative to the prismatic retention member, the attachment retention member may be de fined by other geometric protrusions or extensions, each acting to limit the freedom of movement of the attachment along at least one Cartesian coordinate axis once it is connected to the attachment securing chamber. For example, as with the previous embodiment, the shape of the chambers can themselves function as the attachment retention member. One way to accomplish this is to have the respective openings in each chamber be substantially planar such that the opening defines a cross sectional area smaller than that of any parallel plane within the respective chamber. By making the chambers trapezoidal-shaped, such connection is possible. This way, the chamber forms a geometrically "reverse" tapered surface. In such a reverse taper, the width of the insert widens with insert depth. Rather than a snap-fit, which, if the proper geometric and material configurations are chosen, could result in a permanent connection between the insert and the attachment, this arrangement permits a longitudinal sliding, non-permanent connection between the panel insert and the decorative attachment, as well as a friction fit, which could be effected by spring-biased members on the engaging surface of the attachment that can deploy into the channel of the attachment securing chamber once the attachment is pressed against the opening in the chamber.

According to another embodiment of the invention, a precast panel is disclosed. The panel includes a precast layer defined by an outward-facing surface and an inward-facing surface, and a panel insert integrally formed into the precast layer. The panel insert comprising a unitary structure similar to that of the first embodiment. Optionally, the panel further comprises at least one attachment connected to the attachment securing chamber. Preferably, the attachment is a decorative attachment, although utilitarian attachments, such as hangers, acoustic baffles, signs carrying printed indicia or lighting fixtures could also be used. Moreover, the common base of the panel securing chamber and the outward-facing surface of the precast layer can be substantially coplanar with one another. An inwardly-projecting integral spine is another optional feature, and can include apertures disposed along its length to facilitate improved connectivity with the precast layer. As with the previous embodiment, the attachment securing chambers can also include reverse taper or prismatic features to promote locking.

According to still another embodiment of the invention, a kit for adding decorative attachments to a precast panel is disclosed. The kit comprises a panel insert and at least one decorative attachment. The panel insert is similar to that described in the first embodiment. The decorative attachment includes a substantially outward-facing, or viewable, surface configured to present decorative indicia, and a substantially inward-facing surface with at least one protrusion that is configured to fit into the channel of the attachment securing chamber. "Decorative indicia" may include shapes, colors, relief, printing or other aesthetic accoutrements. Optionally, the kit is configured such that upon assembly, the channel and the protrusion form a complementary engagement with one another, which can be a snap-fit relationship, such as between a plurality of prismatic members on respective channel and protrusion members. As with the previous embodiments, the complementary engagement between the channel and the attachment may come from male-female trapezoidal shapes joined together.

According to yet another embodiment of the invention, a method of manufacturing a precast panel specially configured to accept decorative attachments is disclosed. The method includes configuring a casting surface to accept form liners, placing at least one panel insert in a space defined by the form liners, pouring uncured precast material into the space defined by the form liners such that the precast material at least partially occupies the space defined by interlocking chambers within the panel insert, and curing the precast material. The panel insert comprises a unitary structure substantially similar to that described in the first embodiment. Optionally, the method includes the additional step of securing a decorative attachment to the outer locking chamber once the precast material has cured. Preferably, the attachment securing chamber and a mating surface on the decorative attachment are either matingly shaped or include numerous shaped members on their respective surfaces such that when joined, an interlocking connection is formed. Thus, both the relatively non-permanent connection (through, for example, slidable or frictional fit) and the relatively permanent connection of the snap-fit surfaces can define an "interlocking" connection. If necessary, the panel insert can be temporarily secured to either the panel-forming surface or the form liners prior to pouring the precast material to ensure that the panel insert does not move under the load of the precast material during pouring. As with the previous embodiment, the insert may include an inwardly projecting spine.

According to still another embodiment of the invention, a method of attaching a decorative object to a precast panel is disclosed. The method includes configuring the panel to include at least one panel insert in at least one of its surfaces, and joining the decorative object to an interlocking chamber that makes up the panel insert, which is a unitary structure similar to that defined by the first embodiment. Optionally, the step of joining between the decorative object and the attachment securing chamber is defined by a male-female connection, where the male-female connection comprises either a connection of interlocking prismatic members capable of a snap-fit, or a substantially trapezoidal detent slidably disposed within a substantially trapezoidal cavity defined by the attachment securing chamber. The panel insert may further include at least one inwardly-projecting integral spine to enhance attachment between the insert and the panel. Also as with the previous embodiments, the spine may include apertures to enhance panel insert attachment to the panel.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1A:
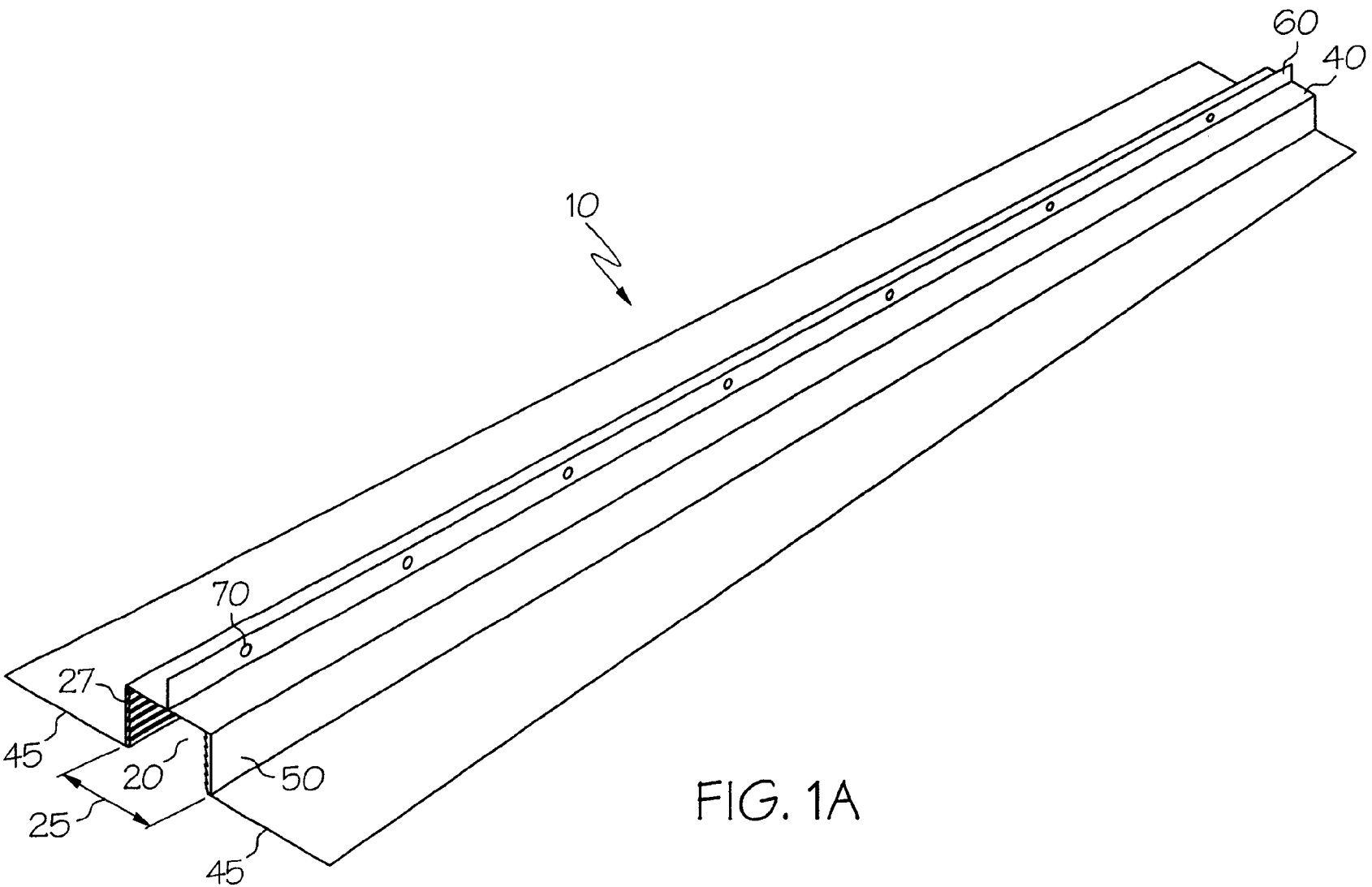
FIG. 1A illustrates a perspective view of a representative length of panel insert according to an embodiment of e invention.

Referring initially to FIG. 1A, a representative length of panel insert 10 is shown. Panel insert 10 is divided up into one or more attachment securing chambers 20 that, together with an opening 25 therein, define a channel. In the configuration shown, each chamber 20 is made up of a base 40 and a pair of sidewalls 50 spaced apart along the lateral sides of the base 40, although other shapes (not shown) are equally applicable, including tapered and semicylindrical chambers. Laterally-spaced flanges 45 angularly extend from the outermost portion of sidewalls 50 such that the opening 25 is situated between them. The flanges 45 are shown as being of generally planar construction, and positioned at right angles to their adjacent sidewall 50, although it will be appreciated by those skilled in the art that the flanges can be canted relative to the sidewalls 50 at other angles, depending on the panel application. One or more attachment retention members 27 extend from the walls of the chamber 20 to secure an attachment (not presently shown) to the insert 10. While the attachment retention members 27 are shown in a preferably prismatic shape, others are equally applicable, as long as they serve to restrain attachment motion along at least one direction. The insert 10 is shown in its preferably elongate configuration, where the channel (defined by chamber 20 and opening 25) takes on an extended longitudinal dimension. A spine 60 extends from the base 40 of the attachment securing chamber 20. Apertures 70 disposed within the spine 60 facilitate continuity of precast material (which is, for example, concrete) across the opposing faces of spine 60 so that, upon curing, a rigid, secure anchor is formed between the panel and the panel insert 10. The entire insert 10 is made from a single piece of plastic material, and can be made by either injection molding or, more preferably, extrusion. In cases where the insert 10 is extruded, the apertures 70 can be added after the extrusion process. In either case, the insert 10 can be formed to any desired length, such as by cutting from a continuous length of extruded material, or by injection molding it to the desired lengthwise dimension. As will be discussed in more detail below, the chambers 20 with the sidewalls 50 can be made to form snap-fit and other forms of engagement with a complementary surface on the attachment.

Figure 1B:
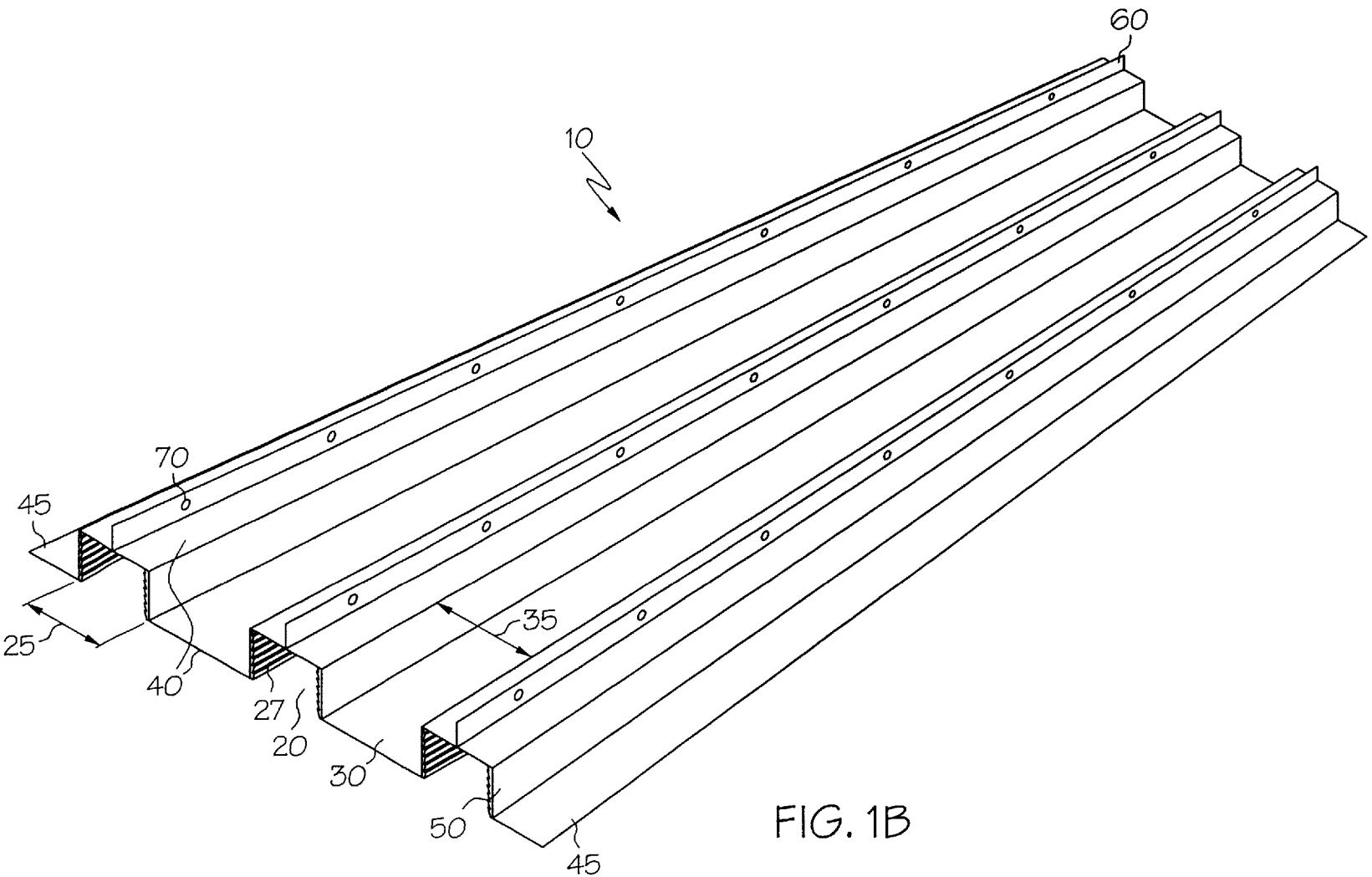
FIG. 1B illustrates a perspective view of a representative length of panel insert according to another embodiment of the invention.

Referring next to FIG. 1B, a panel 10 with numerous attachment securing chambers 20 and panel securing chambers 30 arranged side-by-side is shown. The openings of the chambers are designated as 25 and 35, respectively. Although presently shown with smooth walls, the panel securing chambers 30 could include features that would improve connectivity between the insert 10 and the panel (not presently shown). Such features could include the attachment retention members 27 shown, or any other shape that would promote a more secure anchoring between the panel and insert 10. The base 40 of each panel securing chamber 30 is similar in construction and geometry to the base 40 of the attachment securing chamber 20, and is accordingly numbered the same throughout this disclosure.

Figure 1C:
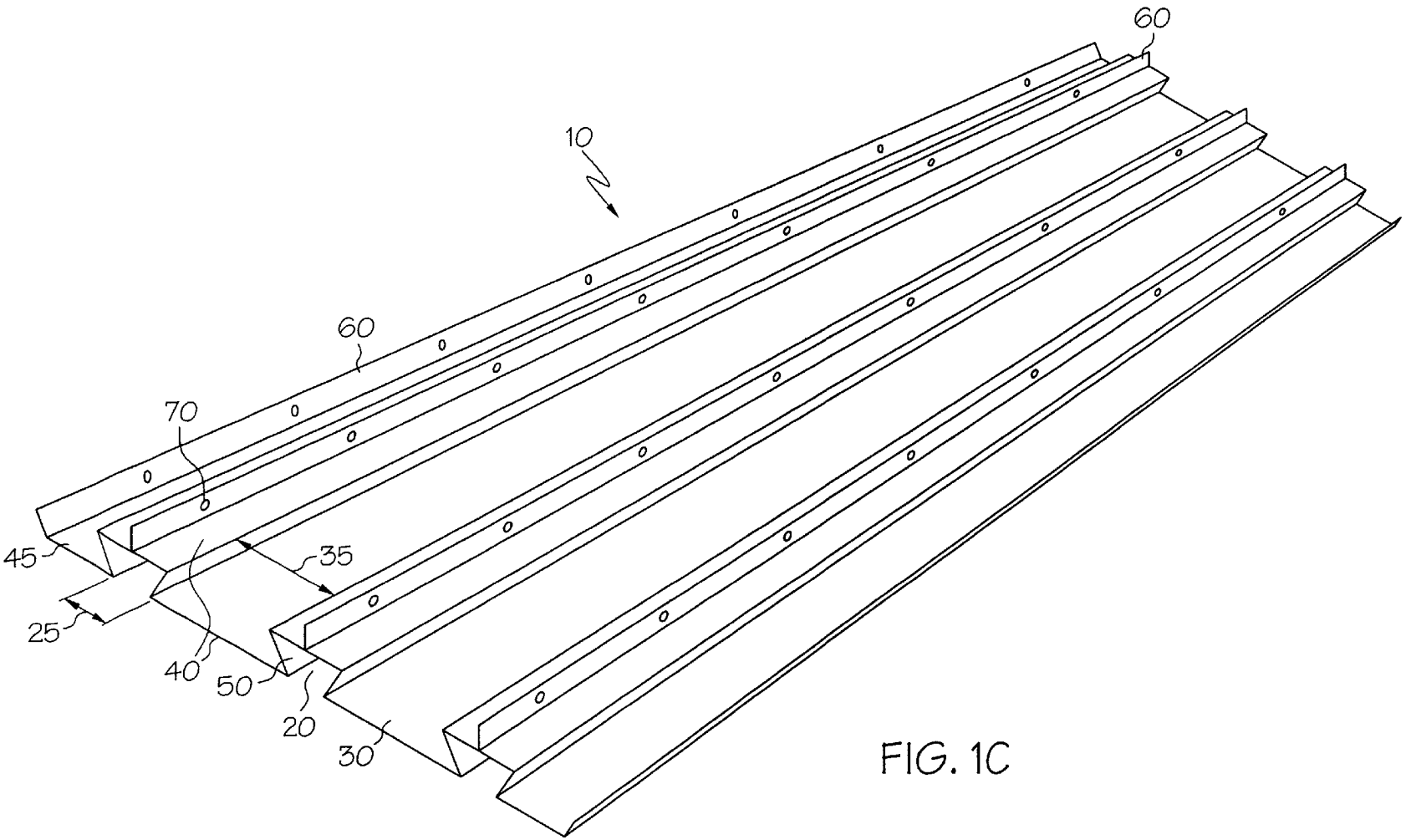
FIG. 1C illustrates a perspective view of a representative length of panel insert according to another embodiment of the invention.

Referring next to FIG. 1C, a representative length of panel insert 10 is shown with a different sidewall 50 and related connection arrangement, as well as additional locations for the placement of one or more integral spines 60. In other regards, the present insert is similar to that of FIG. 1B. The shape of the attachment securing chamber 20 is of a reverse taper arrangement such that the openings 25 in each of the attachment securing chambers 20 define a throat to the cavity in the chamber below. Thus, the cross sectional area within any plane in the chamber 20 parallel to that defined by the opening 25 is greater than that of the opening 25 so that as the depthwise distance in the chamber 20 increases, so does the cross sectional area. While both the attachment and panel securing chambers 20, 30 are preferably trapezoidal in shape to promote efficient locking between the panel insert 10 and the precast panel (not presently shown) to which it is attached, they are not so limited in the present invention. As will be discussed in more detail below, chambers 20 with the reverse taper sidewalls 50 can engage a corresponding attachment by friction fit (including permanent or semi-permanent snap-fit) or by a slidable fit.

Figure 2A:
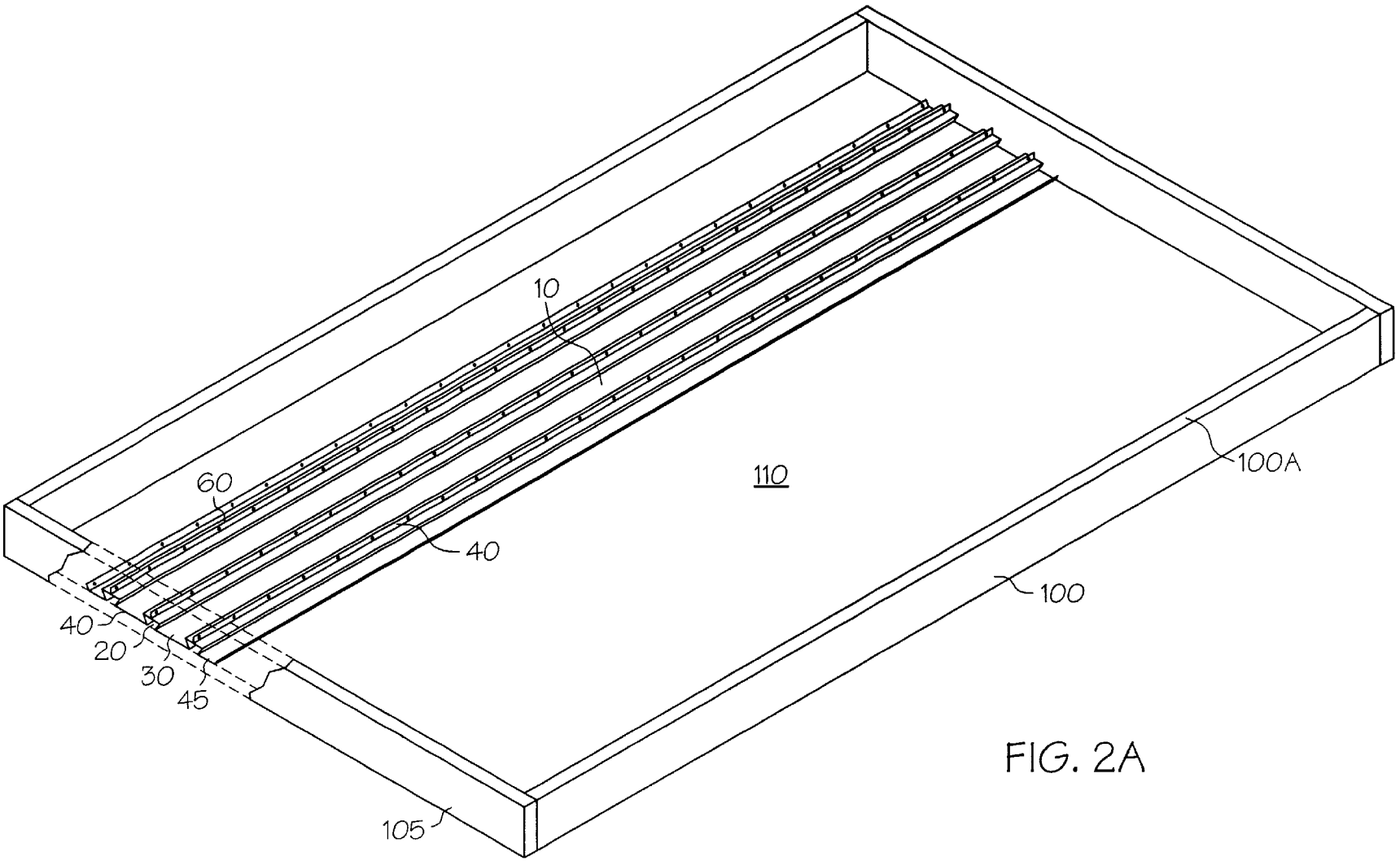
FIG. 2A illustrates the relative placement of the panel insert of FIG. 1C and a conventional form used to prepare a precast panel prior to the placement of the panel.
Figure 2B:
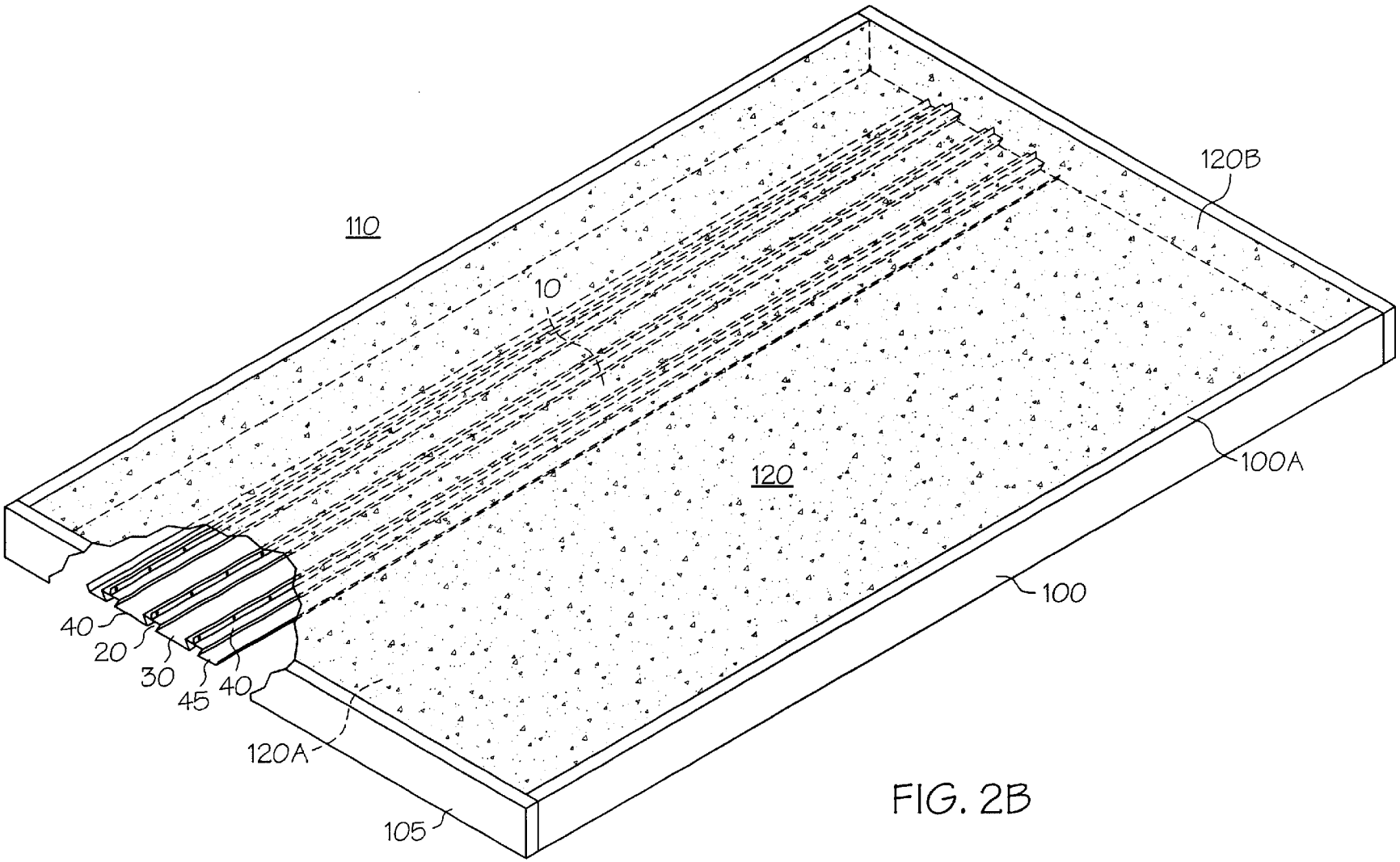
FIG. 2B illustrates the relative placement of the panel insert of FIG. 1C and a conventional form liner used to prepare a precast panel after the panel has been poured into the form liner.

Referring next to FIGS. 2A and 2B, the panel insert 10 from FIG. 1C is shown placed in form liner 100, both resting on a casting surface 110, which is typically a smooth floor or similar surface for ease of panel fabrication. While FIG. 2A only shows one panel insert 10 placed into form liner 100, it will be appreciated by those skilled in the art that numerous such panel inserts can be included, depending on the decorative or architectural needs. Typically, form liner 100 is made up of a series of wooden planks 105 (for example, two-by-fours) secured together by conventional means, such as with nails or screws. In the event a thicker panel (not presently shown) is being produced, wider sections of wooden planks could be used in form liner 100. The attachment securing chambers 20 are placed face-down on casting surface 110 such that the bases 40 of panel securing chambers 30, as well as lateral flanges 45, are resting on the casting surface, while the spines 60 are projecting vertically upward.

As shown with particularity in FIG. 2B, once the panel insert 10 is in place relative to the form liner 100, the material making up panel 120 can be poured into or otherwise placed in the space defined by the form liner 100. In cases where the material is concrete, an additional step of providing a release layer is often included prior to pouring the concrete. Release layers can include sheets of relatively non-stick plastic, spray-on coatings or the like. The release layer promotes separation of the cured panel 100 from the casting surface 110. The height of the planks 105 dictates the thickness of the finished panel 100, and since the panel 100 is thicker than the panel insert 10, the poured panel material flows into panel securing chambers 30 and apertures 70 of spines 60 and up to the top surface 100A of form liner 100, thereby completely covering panel insert 10. By this placement, when panel 120 is formed, cured and tilted-up in a generally vertical position, the outward-facing surface 120A of panel 120 containing attachment securing chambers 20 would be exposed for viewing, while the inward-facing surface 120B would be generally out of sight, facing for example the support structure within a building. While the panel insert 10 shown is preferably coplanar to ensure compatibility with the outward-facing surface 120A of panel 120, it need not be. Thus, if the panel being formed is non-planar, defining an arc of a circle for example, the panel insert 10 could be similarly contoured.

The extrusion process, which can yield generally elongate parts with a user-defined length, is amenable to the simple, low cost fabrication strategy of the present invention, including non-planar shapes. While the chambers 20, 30 of panel insert 10 shown in the present embodiment are of a generally trapezoidal shape, it will be appreciated by those of ordinary skill in the art that the present invention is not so limited, as the chambers could take on numerous other conventional shapes, depending on the architectural or decorative need. For example, the chambers could be rectangular, where the laterally-spaced sidewalls 50 and the base 40 are at right angles to one another. Such a shape could further reduce manufacturing costs of the panel insert 10, and with the presence of the apertures 70 within the spines 60, would still provide the necessary anchor to panel 120. It will also be appreciated by those skilled in the art that the placement of the insert 10 into the panel 100 is similar, regardless of whether the connection between the insert 10 and the attachment (not presently shown) is effected through friction fit, adhesion or a sliding fit.

Figure 3:
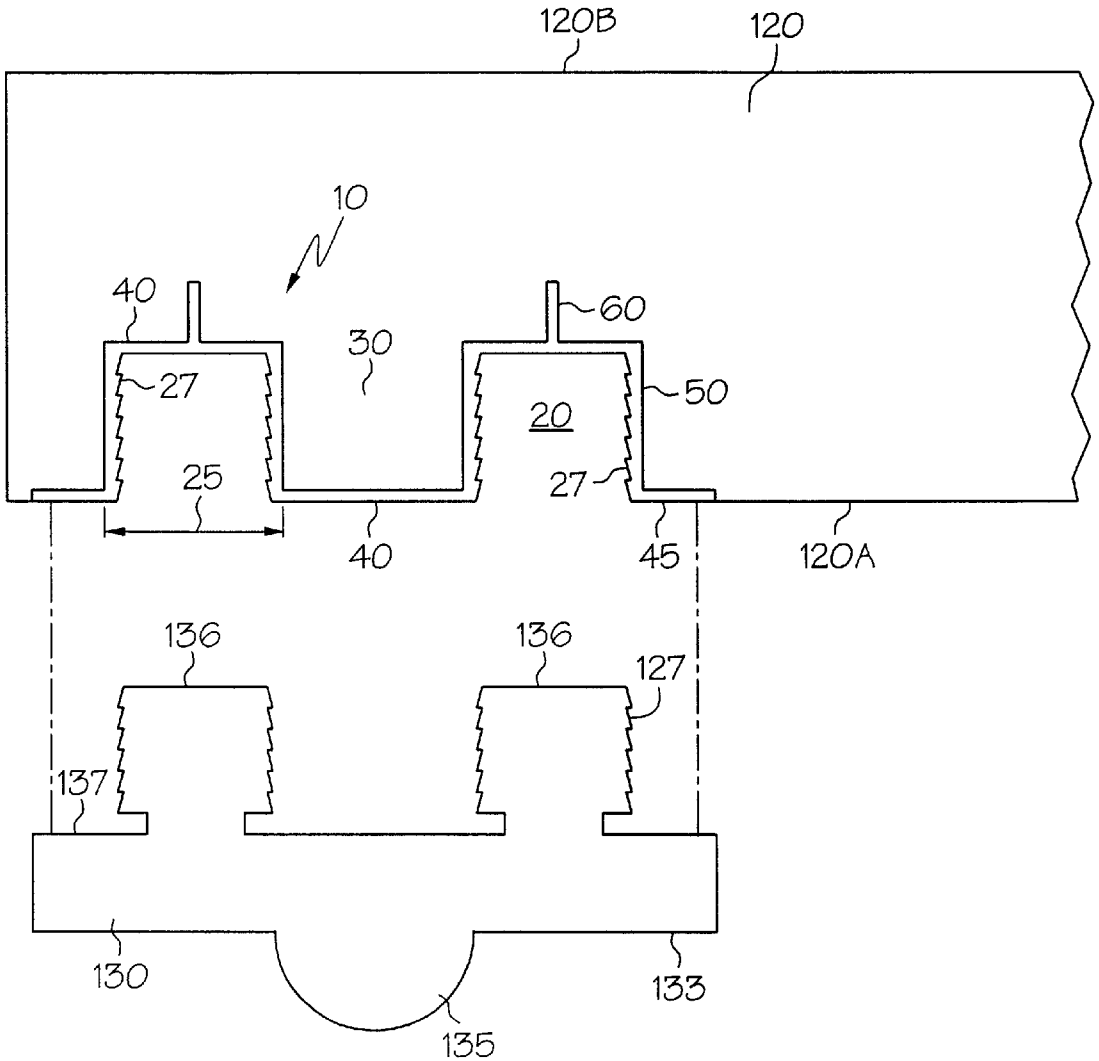
FIG. 3 illustrates a top view of the panel insert of FIG. 1B integrally formed into a precast panel, as well as a decorative attachment prior to a snap-fit locking engagement with the panel insert.

Referring next to FIG. 3, a top view of a finished precast panel 120 that includes at least one panel insert 10 of the snap-fit variant is shown. As previously mentioned, outward-facing surface 120A is the surface of panel 120 that would be viewed by an observer. Attachment securing chambers 20 are similarly exposed, and the one or more bases 40 of panel securing chambers 30 are substantially flush with outward-facing surface 120A, as are the lateral flanges 45. As used in conjunction with the present disclosure, the term "substantially" refers to an arrangement of elements or features that, while in theory would be expected to exhibit exact correspondence or behavior, may in practice embody something slightly less than exact. For example, in the present context, even if a surface or element did not possess precisely the desired quality, by being "substantially" of that quality, its approximation to such quality would be encompassed under the present definition. Sidewalls 50 include the prismatic 27 pattern to improve connectivity between the attachment securing chambers 20 and attachment 130. Detents 130 on the inward-facing surface 137 of decorative attachment 130 are in number, size and shape similar to attachment securing chambers 20 of the panel insert 10 to enable a male-female keyed engagement between the attachment 130 and the panel insert 10. Prismatic 27 pattern on panel insert 10 is complemented by prismatic patterns 127 on the detents 136 of decorative attachment 130. By pressing decorative attachment 130 into panel insert 10, the respective patterns 27, 127 will snap-fit together in a locking arrangement, thus providing architectural accoutrements to outward-facing surface 120A. Moreover, by proper selection of the fit, as well as material properties, the connection between the panel insert 10 and the decorative attachment 130 can be permanent. In the example shown, decorative attachment 130 includes on its outward-facing surface 133 a semicircular column 135. Other shapes, as well as relief and patterned surfaces, are also contemplated as being embraced by the present invention.

Figure 4:
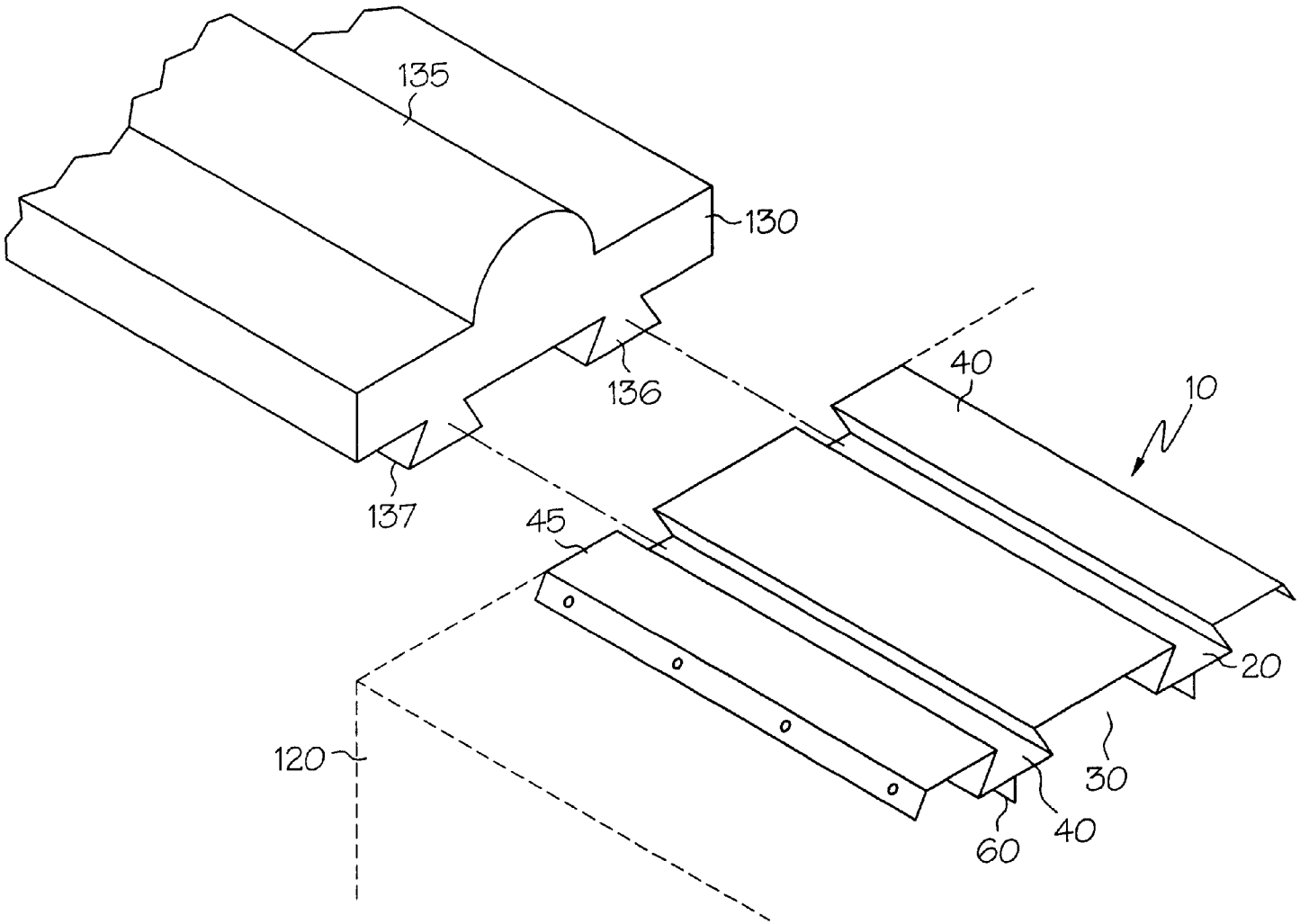
FIG. 4 illustrates a perspective view of the slidable locking engagement between the panel insert of FIG. 1C and a decorative attachment.

FIG. 4 shows the interconnect relationship between the slide-fit variant of a portion of the panel insert 10 and the decorative attachment 130. Unlike with the snap-fit variant shown in FIG. 3, decorative attachment 130 is translated such that its inward-facing surface 137 is in a slidable face-to-face relationship with base 40 and flanges 45. Detents 136 are aligned with attachment securing: chambers 20 so that upon longitudinal sliding engagement between the two, the trapezoidal-shaped detents 136 and attachment securing chambers 20 define a male-female locking connection. Also unlike the variant shown in FIG. 3, this connection, while locking, is not permanent, as the decorative attachment 130 can be slid out along the longitudinal direction of the one or more attachment securing chambers 20. This can be advantageous in circumstances where the architectural features of the wall can be changed as the need arises, such as due to changes in decorative fashion and tastes over time.

Figure 5:
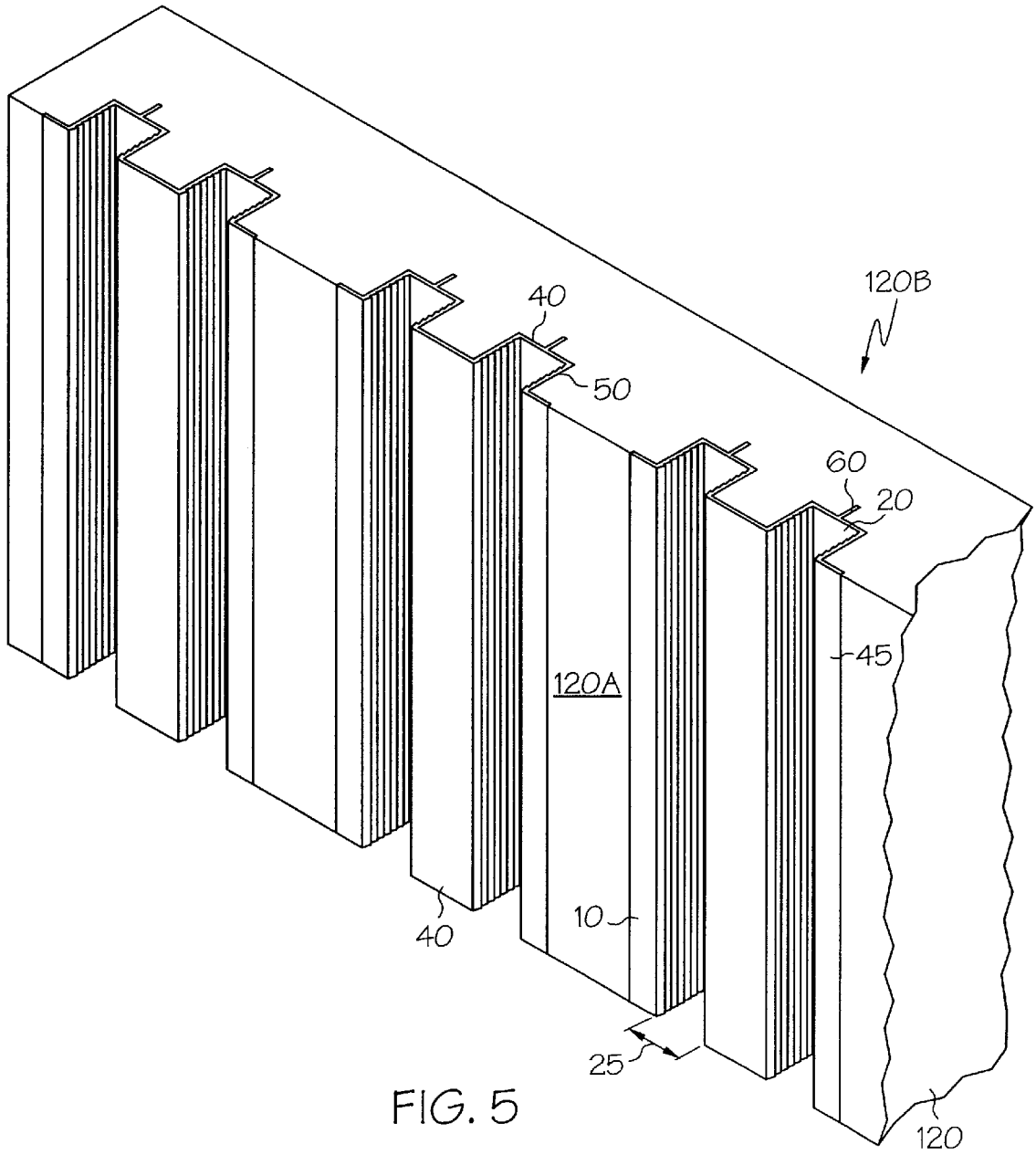
FIG. 5 illustrates a precast concrete wall in its tilted-up position with a plurality of panel insertes of FIG. 1B integrally cast therein.
Figure 6:
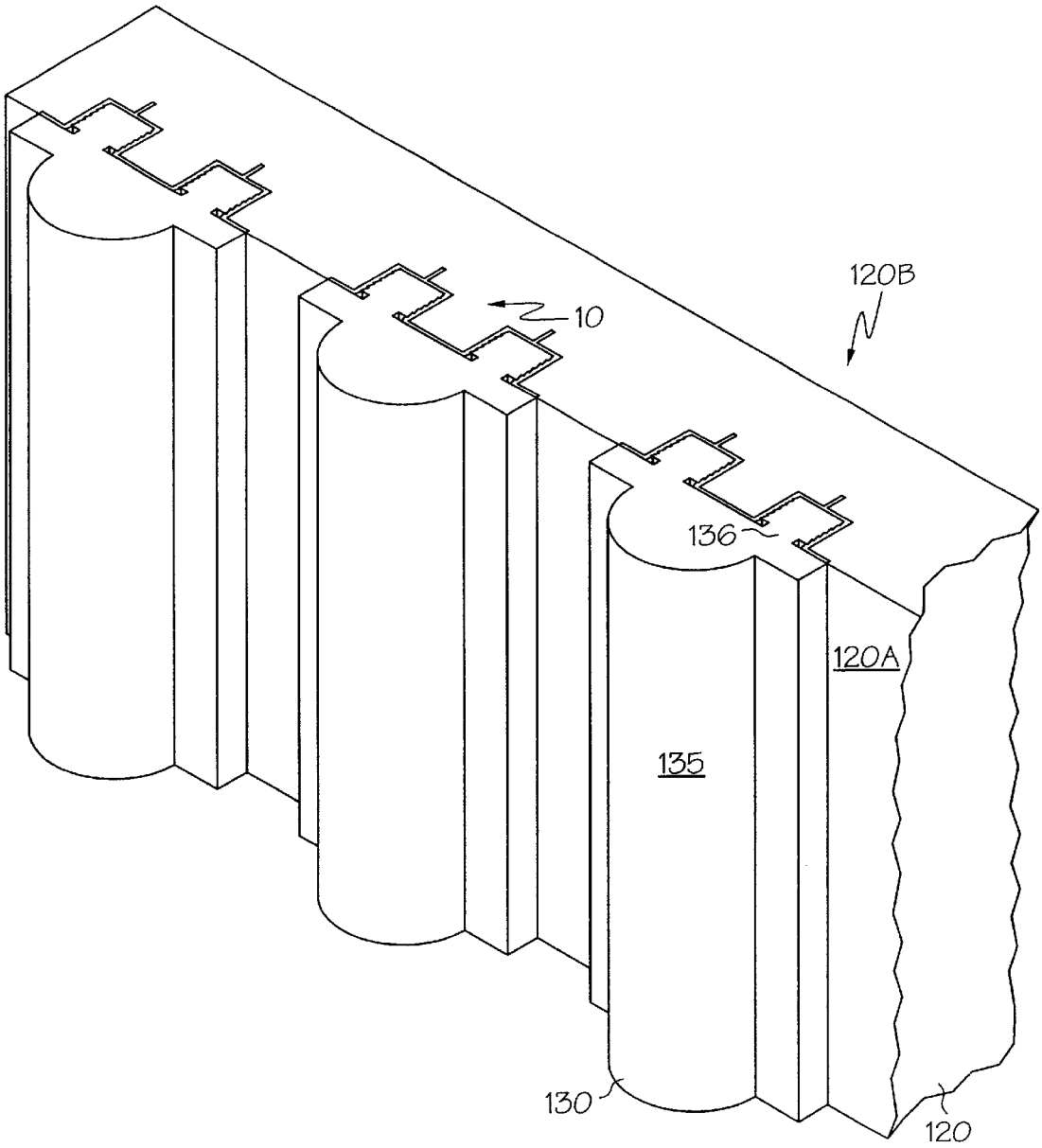
FIG. 6 illustrates the precast concrete wall of FIG. 5 with decorative attachments secured thereto.

Referring lastly to FIGS. 5 and 6, a panel 120 with a plurality of snap-fit panel inserts 10 of the present invention is shown in the panel's preferably vertical orientation. The shape of the attachment securing chambers 20 of the panel insert 10 is such that each of the chambers forms a locking structure due to the snap-fit between the prismatic 27 pattern on the sidewall 50 of attachment securing chamber 10. In the example depicted in FIGS. 5 and 6, the attachment securing chambers 20 are continuous along the panel insert 10 longitudinal direction. This can be advantageous in that it allows imprecise positioning of the corresponding detents 136 of the decorative attachment 130 along its longitudinal dimension, thereby simplifying installation of the attachment 130. It will be appreciated by those skilled in the art that discrete panel inserts (not shown) can be made by cutting the insert 10 shown in the figures into shorter segments such that they can be placed at various user-defined locations within the panel 120. This approach can be beneficial in situations requiring discrete placement of particular architectural features, as shorter insert lengths have added flexibility over their longer counterparts. Customers requiring particular decorative features placed in custom locations on the panel can affordably have these features made-to-order or may choose from selected lengths.

Although not shown, the panel 120 could in the alternative accept the slide-fit variant of the panel insert 10, such as the aforementioned trapezoidal-shaped members, where the cross sectional area of the opening 25 within attachment securing chamber 20 is smaller than any comparable parallel plane deeper within the cavity defined by the chamber. This would permit the decorative attachment 130 to be slidably engaged with the panel insert 10 such that any rigid structural member (such as detents 136) with exterior dimensions substantially conforming to the attachment securing chamber 20 will resist removal from the chamber in any direction with a component outside the plane formed by the opening. In other words, the only way to insert or remove decorative attachment 130 is to slide it lengthwise relative to the panel insert 10 until one or more detents 136 form a keyed engagement with a corresponding number of attachment securing chambers 20. This ensures that once the precast panel 120 with decorative attachments 130 is in place, the connection remains secure.

Having described the invention in detail and by reference to preferred embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A panel insert configured to be integrally formed into a precast panel such that upon curing of said panel, said insert defines a portion of an outer face of said panel to enable attachments to be connected thereto, said insert comprising a unitary structure including:

a pair of generally planar and laterally-spaced flanges defining an opening therebetween; and an attachment securing chamber in connection with said plurality of generally planar and laterally-spaced flanges at said opening such that said opening and said attachment securing chamber together define a channel in said panel insert, said channel comprising at least one attachment retention member.

2. A panel insert according to claim 1, wherein said at least one attachment retention member is defined by said opening.

3. A panel insert according to claim 2, wherein said at least one attachment retention member comprises a sidewall of said attachment securing chamber.

4. A panel insert according to claim 3, wherein said sidewall diverges in a direction going into said channel from said opening.

5. A panel insert according to claim 1, wherein said attachment retention member is configured to form a frictional fit with said attachment.

6. A panel insert according to claim 1, wherein said attachment retention member is configured to form a slidably engageable connection with said attachment.

7. A panel insert according to claim 5, wherein said frictional fit is a snap-fit such that a permanent connection between said attachment and said insert is effected.

8. A panel insert according to claim 5, wherein said attachment retention member comprises plurality of prismatic retention members disposed on at least one surface of said attachment securing chamber such that said plurality of prismatic retention members are configured to engage a complementary surface of said attachment.

9. A panel insert according to claim 1, wherein said pair of generally planar and laterally-spaced flanges are substantially coplanar with each other.

10. A panel insert according to claim 9, wherein said pair of generally planar and laterally-spaced flanges are substantially coplanar with said at least one attachment securing chamber.

11. A panel insert according to claim 1, further comprising at least one inwardly-projecting spine extending from said attachment securing chamber, said at least one inwardly-projecting integral spine configured to engage said precast panel.

12. A panel insert according to claim 11, wherein said at least one inwardly-projecting integral spine includes a plurality of apertures disposed therein to facilitate improved connectivity with said precast panel.

13. A panel insert according to claim 1, wherein said attachment securing chamber further comprises a pair of laterally-spaced sidewalls joined by a common base.

14. A panel insert according to claim 1, further comprising at least one inwardlyprojecting spine extending from one of said pair of generally planar and laterally-spaced flanges, said at least one inwlardly-projecting integral spine configured to engage said precast panel.

15. A panel insert according to claim 1, wherein said unitary structure is made of extruded plastic such that said generally planar and laterally-spaced flanges and said attachment securing chamber extend along parallel longitudinal dimensions.

16. A panel insert according to claim 1, wherein the shape of said attachment securing chamber is such that said opening is substantially planar and defines a cross sectional area smaller than that of any parallel plane within said chamber.

17. A panel insert according to claim 1, wherein said attachment securing chamber is substantially trapezoidal-shaped.

18. A panel insert according to claim 1, wherein said at least one attachment retention member is disposed on at least one of said laterally-spaced sidewalls.

19. A panel insert configured to be integrally formed into a precast panel such that upon curing of said panel, decorative attachments may be connected thereto via said insert, said insert comprising a unitary structure and including:

at least one attachment securing chamber defined by a pair of laterally-spaced sidewalls joined by a common base such that said pair of laterally-spaced sidewalls define an opening therebetween;

at least one panel securing chamber defined by a pair of laterally-spaced sidewalls joined by a common base such that said pair of laterally-spaced sidewalls define an opening therebetween; and a plurality of generally planar flanges laterally disposed relative to said at least one attachment securing chamber or said at least one panel securing chamber.

20. A panel insert according to claim 19, further comprising at least one inwardly-projecting integral spine extending from said at least one attachment securing chamber, said at least one inwardly-projecting integral spine configured to engage said precast panel.

21. A panel insert according to claim 20, wherein said at least one inwardly-projecting integral spine includes a plurality of apertures disposed therein to facilitate improved connectivity with said precast panel.

22. A panel insert according to claim 19, further comprising at least one inwardly-projecting integral spine extending from one of said plurality of generally planar flanges, said at least one inwardly-projecting integral spine configured to engage said precast panel.

23. A panel insert according to claim 19, wherein at least one of said pair of laterally-spaced sidewalls has a plurality of prismatic retention members disposed thereon such that said plurality of prismatic retention members are configured to engage a complementary surface of said decorative attachment.

24. A panel insert according to claim 19, wherein said at least one attachment securing chamber and said at least one panel securing chamber are alternately juxtaposed relative one another such that said laterally-spaced sidewalls that are disposed therebetween are common to both.

25. A precast panel comprising:

a precast layer defined by an outward-facing surface and an inward-facing surface; and a panel insert integrally formed into said precast layer, said panel insert comprising a unitary structure including:

a plurality of generally planar and laterally-spaced flanges defining an opening therebetween; and an attachment securing chamber in connection with said plurality of generally planar and laterally-spaced flanges at said opening such that said opening and said attachment securing chamber together define a channel in said panel insert, said channel comprising at least one attachment retention member.

26. A precast panel according to claim 25, wherein said attachment is a decorative attachment.

27. A precast panel according to claim 25, wherein said channel includes a pair of laterally-spaced sidewalls joined by a common base.

28. A precast panel according to claim 27, wherein said pair of laterally-spaced sidewalls further comprise a plurality of prismatic retention members disposed thereon.

29. A precast panel according to claim 28, wherein said attachment includes at least one surface defined by a shape to effect complementary connection with said plurality of prismatic retention members.

30. A precast panel according to claim 25, further comprising at least one inwardly-projecting spine extending from said attachment securing chamber, said at least one inwardly-projecting spine including a plurality of apertures disposed therein to facilitate improved connectivity with said precast layer.

31. A precast panel according to claim 25, further comprising at least one inwardly-projecting spine extending from said generally planar and laterally-spaced flanges, said at least one inwardly-projecting spine including a plurality of apertures disposed therein to facilitate improved connectivity with said precast layer.

32. A precast panel according to claim 25, further comprising at least one attachment connected to said at least one attachment securing chamber.

33. A precast panel according to claim 25, wherein said at least one attachment retention member is defined by said opening.

34. A precast panel according to claim 33, wherein said at least one attachment retention member comprises a sidewall of said attachment securing chamber.

35. A precast panel according to claim 34, wherein said sidewall diverges in a direction going into said channel from said opening.

36. A panel insert configured to be integrally formed into a precast panel such that upon curing of said panel, said insert defines a portion of an outer face of said panel to enable attachments to be connected thereto, said insert comprising:

a pair of laterally-spaced flanges defining an opening therebetween; and an attachment securing chamber in connection with said plurality of flanges at said opening such that said opening and said attachment securing chamber together define a channel in said panel insert, said channel comprising at least one attachment retention member.

37. A kit for adding decorative attachments to a precast panel, said kit comprising:

a panel insert configured to be integrally formed into a precast panel such that upon curing of said panel, said insert defines a portion of an outer face of said panel to enable attachments to be connected thereto, said insert comprising a unitary structure including:

a pair of generally planar and laterally-spaced flanges defining an opening therebetween; and an attachment securing chamber in connection with said plurality of generally planar and laterally-spaced flanges at said opening such that said opening and said attachment securing chamber together define a channel in said panel insert; and at least one Decorative attachment comprising:

a substantially outward-facing surface configured to present decorative indicia; and a substantially inward-facing surface with at least one protrusion therefrom, said at least one protrusion configured to fit into said channel of said attachment securing chamber.

38. A kit according to claim 37, wherein said kit is configured such that upon assembly, said channel and said at least one protrusion form a complementary engagement with one another.

39. A kit according to claim 38, wherein said complementary engagement is a snap-fit relationship.

40. A kit according to claim 39, wherein each of said channel and said at least one protrusion are defined by a plurality of prismatic members to effect said snap-fit relationship therebetween.

41. A method of manufacturing a precast panel comprising:

configuring a casting surface to accept form liners;

placing at least one panel insert in a space defined by said form liners, said at least one panel insert comprising a unitary structure defined by a plurality of generally planar arid laterally-spaced flanges defining an opening therebetween and an attachment securing chamber in connection with said plurality of generally planar flanges at said opening such that said opening and said attachment securing chamber together define a channel in said panel insert, said channel comprising at least one attachment retention member;

pouring uncured precast material into said space defined by said form liners such that said precast material covers at least said attachment securing chamber, thereby leaving the portion of an outer.;surface of said panel defined by said insert exposed to said casting surface; and curing said precast material.

42. A method according to claim 41, comprising the additional step of securing a decorative attachment to said attachment securing chamber once said precast material has cured.

43. A method according to claim 42, wherein said attachment securing chamber and a mating surface on said decorative attachment are complementary-shaped relative to one another such that upon connection therebetween, an interlocking engagement is formed.

44. A method according to claim 43, wherein said panel insert further includes at least one inwardly-projecting integral spine to enhance attachment between said panel insert and said precast panel.

45. A method according to claim 41, wherein said at least one attachment retention member is defined by said opening.

46. A method according to claim 45, wherein said at least one attachment retention member comprises a sidewall of said attachment securing chamber.

47. A method according to claim 46, wherein said sidewall diverges in a direction going into said channel from said opening.

48. A method of attaching a decorative object to a precast panel, said method comprising:

configuring said precast panel to include at least one panel insert in a surface thereof, said panel insert comprising a unitary structure defined by a plurality of generally planar and laterally-spaced flanges defining an opening therebetween and an attachment securing chamber in connection with said plurality of generally planar flanges at said opening such that said opening and said attachment securing chamber together define a channel in said panel insert; and joining said decorative object to said channel.

49. A method according to claim 48, wherein said joining between said decorative object and said channel is defined by a male-female connection.

50. A method according to claim 49, wherein said male-female connection comprises a substantially trapezoidal detent on said decorative object being disposed within a substantially trapezoidal cavity defined by said attachment securing chamber.

51. A method according to claim 49, wherein said male-female connection comprises:

a detent disposed on said decorative object, said detent defined by a plurality of prismatic retention members on at least on surface thereof; and at least one complementary surface disposed within said channel.

* * * * *

UNITED STATES PATENT AND TRADEMARK OFFICE

CERTIFICATE OF CORRECTION

PATENT NO. : 6,631,599 B1
DATED : October 14, 2003
INVENTOR(S) : Kyozaburo Takagi It is certified that error appears in the above-identified patent and that said Letters Patent is hereby corrected as shown below:

Column 10,
Line 30, “inwardlyprojecting” should be -- inwardly-projecting --
Line 32, “inwlardly-projecting” should be -- inwardly-projecting --

Column 12,
Line 54, “arid” should be -- and --
Line 64, “of an outer.;surface” should be -- of an outer surface --

Signed and Sealed this

Sixth Day of July, 2004

JON W. DUDAS
*Acting Director of the United States Patent and Trademark Office*